US011337520B2

(12) United States Patent
Park

(10) Patent No.: US 11,337,520 B2
(45) Date of Patent: May 24, 2022

(54) SLIDING DEVICE FOR DRAWER

(71) Applicant: SEGOS, Incheon (KR)

(72) Inventor: Sang Eun Park, Incheon (KR)

(73) Assignee: SEGOS, Incheon (KR)

( * ) Notice: Subject to any disclaimer, the term of this patent is extended or adjusted under 35 U.S.C. 154(b) by 0 days.

(21) Appl. No.: 16/956,034

(22) PCT Filed: Nov. 29, 2018

(86) PCT No.: PCT/KR2018/014890
§ 371 (c)(1),
(2) Date: Jun. 19, 2020

(87) PCT Pub. No.: WO2019/124798
PCT Pub. Date: Jun. 27, 2019

(65) Prior Publication Data

US 2020/0405053 A1 Dec. 31, 2020

(30) Foreign Application Priority Data

Dec. 21, 2017 (KR) ..... 10-2017-0177387

(51) Int. Cl.
*A47B 88/477* (2017.01)
*A47B 88/483* (2017.01)
(Continued)

(52) U.S. Cl.
CPC ..... *A47B 88/477* (2017.01); *A47B 88/483* (2017.01); *A47B 88/49* (2017.01); *A47B 88/473* (2017.01)

(58) Field of Classification Search
CPC ..... A47B 88/477; A47B 88/473; A47B 88/49; A47B 88/57; A47B 88/483; A47B 88/423
See application file for complete search history.

(56) References Cited

U.S. PATENT DOCUMENTS 3,650,578 A * 3/1972 Del Vecchio ..... A47B 88/57 384/18
RE28,344 E * 2/1975 Monaco ..... A47B 88/57 384/21
(Continued)

FOREIGN PATENT DOCUMENTS

AT 386 942 B 11/1988
CN 111616532 A * 9/2020
(Continued)

OTHER PUBLICATIONS

Supplementary European Search Report issued in connection with corresponding European patent application No. 18 89 2016 dated Dec. 22, 2021.

*Primary Examiner* — Hanh V Tran
(74) *Attorney, Agent, or Firm* — Tarolli, Sundheim, Covell & Tummino LLP

(57) ABSTRACT

A sliding device is provided for a drawer which may provide a detent function by an elastic displacement to a rail member enabling a storage body to be moved from a main body in a sliding manner, thereby implementing a fixed maintenance force having a more robust state at a drawn-into location of the storage body to the main body. The sliding device includes: a first rail member which has a locking projection, an intermediate rail member coupled to be movable with respect to the first rail member, a second rail member coupled to be movable with respect to the intermediate rail member at a location opposite to the first rail member, and a detent member which is provided on the second rail member, and has an opening which accommodates the locking projection and a constraining protrusion which suppresses the locking projection from being separated from the opening.

8 Claims, 8 Drawing Sheets

(51) Int. Cl.
*A47B 88/49* (2017.01)
*A47B 88/473* (2017.01)

(56) References Cited

U.S. PATENT DOCUMENTS 5,147,138 A * 9/1992 Gutner ..... A47B 88/57 384/21
5,951,132 A * 9/1999 Cirocco ..... A47B 88/493 312/334.46
6,126,255 A * 10/2000 Yang ..... A47B 88/60 312/334.44
6,257,683 B1 * 7/2001 Yang ..... A47B 88/487 312/333
6,729,703 B2 * 5/2004 Le ..... A47B 88/57 312/333
6,764,150 B2 * 7/2004 Le ..... A47B 88/493 312/334.44
6,883,885 B2 * 4/2005 Judge ..... H05K 7/1489 312/334.46
7,458,651 B1 * 12/2008 Radke ..... A47B 88/467 312/333
7,731,313 B2 * 6/2010 Chen ..... H04M 1/0237 312/334.45
8,152,251 B2 * 4/2012 Huang ..... A47B 88/493 312/334.44
9,198,322 B2 * 11/2015 Russell ..... H05K 7/1489
10,092,100 B1 * 10/2018 Chen ..... A47B 88/57
2003/0034720 A1 * 2/2003 Milligan ..... A47B 88/493 312/334.44
2003/0122460 A1 * 7/2003 Chang ..... A47B 88/49 312/334.46
2003/0209959 A1 * 11/2003 Shih-Long ..... A47B 88/49 312/334.46
2014/0152165 A1 6/2014 Zimmermann
2016/0073782 A1 * 3/2016 Kler da Silva ..... A47B 88/49 312/334.44

FOREIGN PATENT DOCUMENTS

CN 111904186 A * 11/2020
DE 20106080 U1 * 6/2001 ..... A47B 88/57
DE 10 2006 007978 A1 8/2007
DE 10 2011 051138 A1 12/2012
GB 2417191 A * 2/2006 ..... A47B 88/493
JP 2000037249 A 2/2000
JP 2001190347 A 7/2001
JP 2004113512 A 4/2004
JP 2004147755 A 5/2004
JP 2011024665 A 2/2011
JP 2017047165 A 3/2017
KR 20110059622 A 6/2011
WO WO-2011094781 A1 * 8/2011 ..... A47B 88/423

* cited by examiner

SLIDING DEVICE FOR DRAWER

RELATED APPLICATIONS

The present invention is a U.S. National Stage under 35 USC 371 patent application, claiming priority to Serial No. PCT/KR2018/014890, filed on 29 Nov. 2018; which claims priority of KR 1020170177387, filed on 21 Dec. 2017, the entirety of both of which are incorporated herein by reference.

TECHNICAL FIELD

The present disclosure relates to a sliding device for a drawer, and more particularly, to a sliding device for a drawer, which may provide a detent function to a rail member which enables a storage body to be moved from a main body in a sliding manner, thereby implementing a fixed maintenance force having a more robust state at a drawn-into location of the storage body to the main body.

BACKGROUND ART

Generally, a main body of furniture or household appliance is provided with a sliding device for opening and closing a storage body such as a drawer, and the sliding device is configured to include a fixed rail installed on the main body, a movable rail installed on the storage body, and a ball cage which enables the movement between these rails in a rolling contact manner.

As an example, the sliding device disclosed in Korean Patent No. 10-1481655 is configured to include, in addition to a fixed rail installed on a main body and a movable rail installed on a storage body, an intermediate rail installed between the fixed rail and the movable rail, an intermediate rail support which is provided between the fixed rail and the intermediate rail to support the intermediate rail to be drawn out from the fixed rail side or drawn into the fixed rail side, a movable rail support which is provided between the intermediate rail and the movable rail to support the movable rail to be drawn out from the intermediate rail side or drawn into the intermediate rail side, and a slip prevention portion which detaches the movable rail and the intermediate rail with different frictional forces during a closing operation and an opening operation of the storage body.

However, since the aforementioned conventional sliding device may not implement a function capable of regulating the fixed location of the movable rail installed on the storage body with respect to the fixed rail installed on the main body when switching the storage body from the drawn-out location to the drawn-into location with respect to the main body, there is a problem in that the storage body may be undesirably drawn out from the main body. Particularly, if the assembled state of the fixed rail and the movable rail does not accurately maintain a horizontal location, or the weight of the article loaded inside the storage body is large in a state where the horizontal state of the floor on which the main body is installed is uneven, the likelihood of occurrence of the same problem may be caused even more.

DISCLOSURE

Technical Problem

An object of the present disclosure is to provide a sliding device for a drawer, which may provide a detent function by an elastic displacement to a rail member which enables a storage body to be moved from the main body in a sliding manner, thereby implementing a fixing maintenance force having a more robust state at a drawn-into location of the storage body to the main body to enhance the convenience of use.

Another object of the present disclosure is to provide a sliding device for a drawer, which may provide a shift manipulation feeling at a drawn-into location and a drawn-out location of the storage body to the main body through the detent function implemented by an elastic displacement by a rail member.

Technical Solution

A sliding device for a drawer according to an exemplary embodiment of the present disclosure for achieving the objects includes: a first rail member which has a locking projection, an intermediate rail member which is coupled to be movable with respect to the first rail member, a second rail member which is coupled to be movable with respect to the intermediate rail member at a location opposite to the first rail member, and a detent member which is provided on the second rail member, and has an opening which accommodates the locking projection and a constraining protrusion which suppresses the locking projection from being separated from the opening, in which the locking projection and the opening are disposed on the same axis based on the moving direction of the first rail member with respect to the second rail member.

In the present disclosure, the detent member has a fixing portion for coupling the second rail member, and an elastic behavior portion which is bent upward from the fixing portion and forms the opening and the constraining protrusion, the elastic behavior portion has a drawn-into guide surface which is bent downward toward the locking projection at a free end of the elastic behavior portion, and the constraining protrusion integrally extends from the elastic behavior portion and is bent downward toward the interior of the opening.

In the present disclosure, the locking projection has a drawn-into inclined surface portion which is inclined downward toward the drawn-into guide surface, and a drawn-out inclined surface portion which is inclined downward toward the constraining protrusion at a location opposite to the drawn-into inclined surface portion, and the drawn-into inclined surface portion and the drawn-out inclined surface portion are formed to protrude to have the same inclination angles based on the locking projection with respect to the first rail member.

In the present disclosure, the second rail member has a locking protrusion which is bent upward for fixing the detent member, the detent member has a recess for coupling the locking protrusion, and perforated holes for the coupling by a riveting are provided in the second rail member and the detent member, respectively.

A sliding device for a drawer according to another exemplary embodiment of the present disclosure includes: a first rail member which has a locking projection, an intermediate rail member which is coupled to be movable with respect to the first rail member, a second rail member which is coupled to be movable with respect to the intermediate rail member at a location opposite to the first rail member, and a detent member which has an elastic behavior portion having an integral structure which is partially cut from the second rail member and is bent upward and disposed to have an interval with and parallel to the second rail member, in which the elastic behavior portion has an opening for accommodating the locking projection therein, a constraining protrusion which is bent downward from the opening, and a drawn-into guide surface which is bent downward toward the locking projection at a free end of the elastic behavior portion, and the locking projection and the opening are disposed on the same axis based on the moving direction of the first rail member with respect to the second rail member.

In the present disclosure, the locking projection has a drawn-into inclined surface portion which is inclined downward toward the drawn-into guide surface, and a drawn-out inclined surface portion which is inclined downward toward the constraining protrusion at a location opposite to the drawn-into inclined surface portion, and the drawn-into inclined surface portion and the drawn-out inclined surface portion are configured to have the same inclination angles based on the locking projection with respect to the first rail member.

Advantageous Effects

The sliding device for the drawer according to an exemplary embodiment of the present disclosure may provide the detent function by the elastic displacement to the rail member which is installed to enable the storage body to be moved from the main body in the sliding manner, thereby implementing the fixing maintenance force having the robust state at the drawn-into location of the storage body to the main body, and accordingly, preventing the undesired flow of the main body more actively.

In addition, the present disclosure allows the user to feel the shift manipulation feeling at each of the drawn-into location and the drawn-out location of the storage body with respect to the main body through the detent function implemented by the elastic displacement according to the mutual contact between the rail member, the locking projection, and the elastic behavior portion of the detent member, thereby enhancing the convenience of use.

DESCRIPTION OF DRAWINGS

FIG. 5 is a cross-sectional diagram illustrating the location relationship between the locking projection and the detent member in an initial state where the rail member is drawn into.

FIG. 6 is a cross-sectional diagram illustrating an elastic displacement of the detent member according to the contact with the locking projection in the drawn-into process of the rail member.

FIG. 7 is a cross-sectional diagram illustrating the location relationship between the locking projection and the detent member in a state where the rail member is completely drawn into.

BEST MODE

Figure 1:
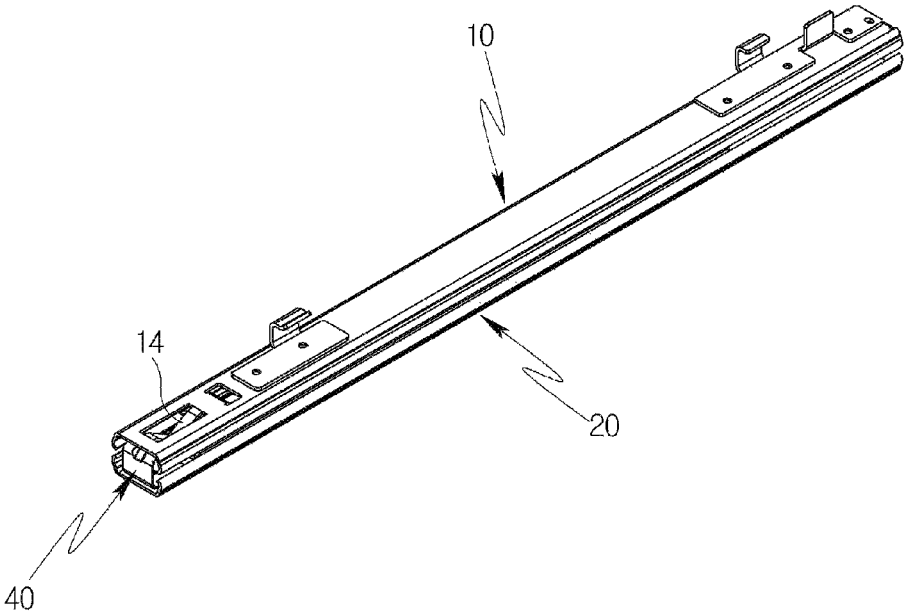
FIG. 1 is a perspective diagram illustrating a state where a sliding device for a drawer according to an exemplary embodiment of the present disclosure is drawn into.
Figure 2:
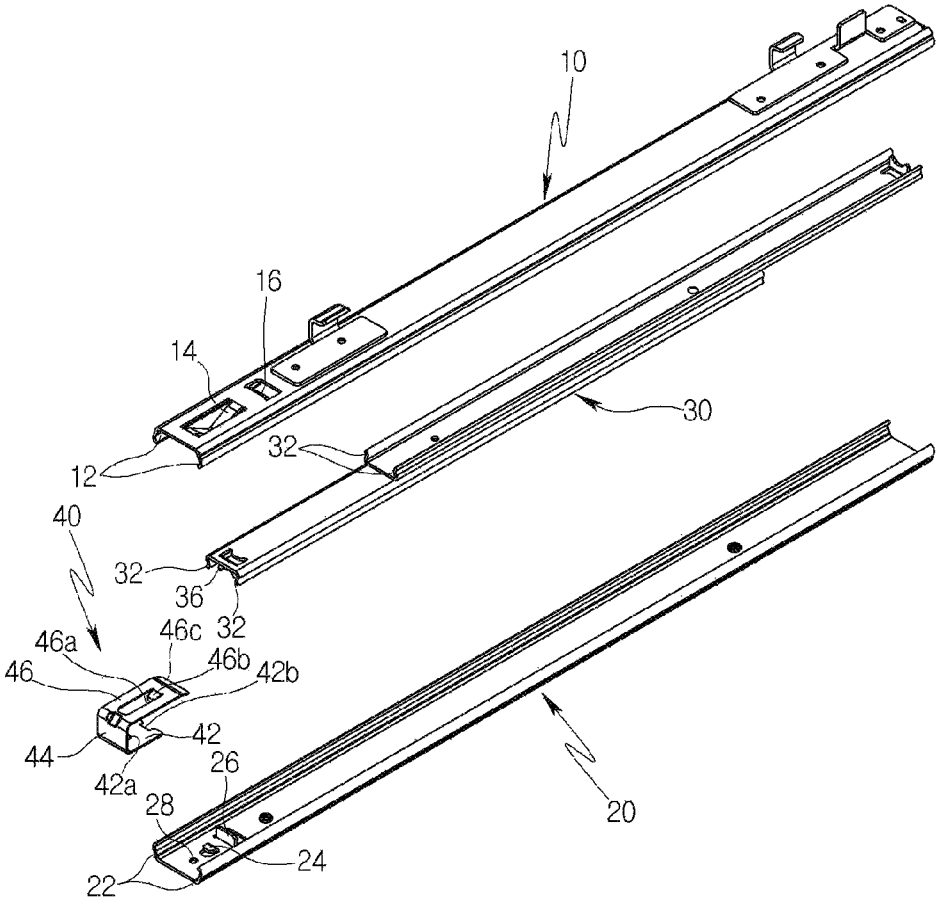
FIG. 2 is an exploded perspective diagram illustrating the sliding device for the drawer illustrated in FIG. 1.
Figure 3:
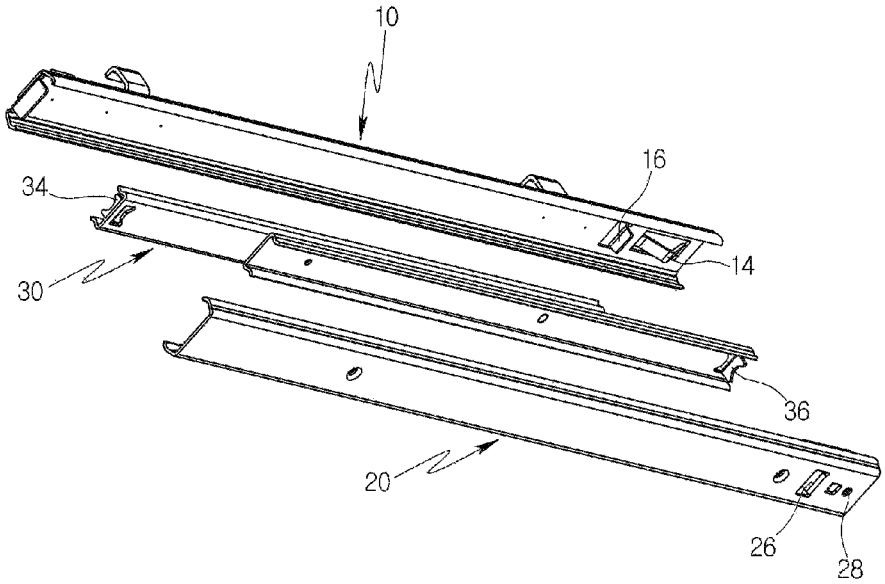
FIG. 3 is a bottom perspective diagram illustrating the sliding device for the drawer illustrated in FIG. 2.
Figure 4:
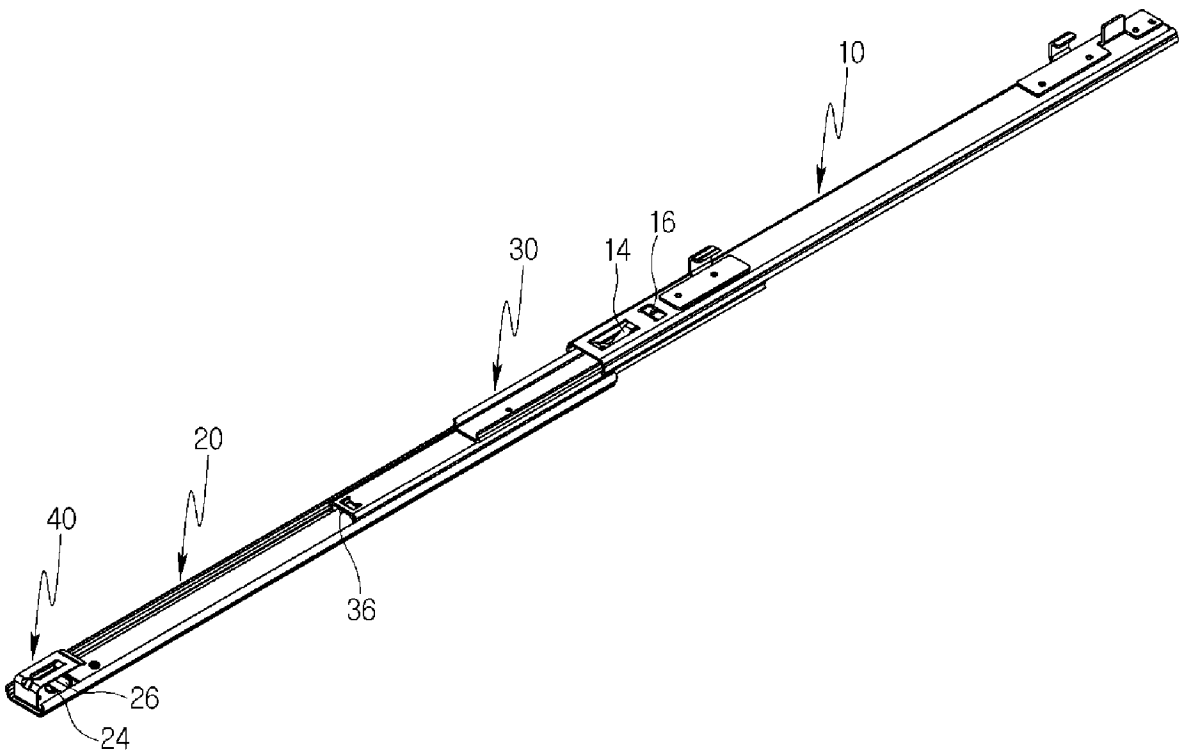
FIG. 4 is a perspective diagram illustrating a state where the sliding device for the drawer illustrated in FIG. 1 is drawn out.

Hereinafter, preferred exemplary embodiments of the present disclosure will be described in detail with reference to the attached exemplary drawings.

Referring to FIGS. 1 to 4, a sliding device for a drawer according to an exemplary embodiment of the present disclosure is configured to include a first rail member 10, a second rail member 20, a pair of intermediate rail members 30 which are movably coupled to the first rail member 10 and the second rail member 20, respectively, and a detent member 40 which implements a detent function by an elastic displacement in a drawn-into process and a drawn-out process between the first rail member 10 and the second rail member 20, respectively.

In this case, the first rail member 10 and the second rail member 20 are selectively fixed to any one of a main body and a storage body to be coupled to be mutually movable through the intermediate rail member 30. An exemplary embodiment of the present disclosure to be described below is described based on a case where the first rail member 10 is fixed to a movable storage body such as a drawer, and the second rail member 20 is fixed to the main body of furniture, household appliance, or the like which accommodates the storage body so as to be drawn into and drawn out in a movable state.

The first rail member 10 is fixed to the storage body, and has a bent portion 12 for supporting the seating of a rolling means (not illustrated) on the side portions opposite to each other along the longitudinal direction. In this case, the rolling means includes a ball cage which rotatably accommodates a plurality of balls, and the bent portion 12 is formed to be bent to have an appropriate curvature for stable contact with the balls of the rolling means.

In addition, the first rail member 10 has a locking projection 14 which protrudes downward toward the interior to face the second rail member 20 to induce an elastic displacement of the detent member 40 when being in contact with the detent member 40. In addition, the first rail member 10 has a stopper 16 which protrudes toward the interior to be in contact with the intermediate rail member 30 at a location spaced apart from the locking projection 14 to limit the drawn-out stroke of the first rail member 10 to the intermediate rail member 30.

Here, the locking projection 14 includes a drawn-into inclined surface portion 14*a* which is formed to be inclined downward toward the detent member 40 to be in contact with the detent member 40 at the drawn-into location, and a drawn-out inclined surface portion 14*b* which is formed to be inclined downward at a portion opposite to the drawn-into inclined surface portion 14*a* to be in contact with the detent member 40 at the drawn-out location, and more preferably, the drawn-into inclined surface portion 14*a* and the drawn-out inclined surface portion 14*b* are configured to be formed to protrude from the first rail member 10 to have the same inclination angles with respect to the locking projection 14.

In this case, the locking projection 14 and the stopper 16 may be provided by bending downward toward the second rail member 20 in the form of partially cutting a material of the first rail member 10.

The second rail member 20 is fixed to the main body, and has a bent portion 22 for supporting the seating of the rolling means (not illustrated) on the side portions opposite to each other along the longitudinal direction. Even in this case, the bent portion 22 is formed to be bent to have an appropriate curvature for stable contact with the balls of the rolling means.

In addition, the second rail member 20 has a bending-type locking protrusion 24 which protrudes downward toward the interior for fixing the detent member 40. In addition, the second rail member 20 has a stopper 26 which protrudes toward the interior to be in contact with the intermediate rail member 30 at a location spaced apart from the locking protrusion 24 to limit the drawn-out stroke of the second rail member 20 to the intermediate rail member 30.

In this case, the locking protrusion 24 and the stopper 26 may be provided by bending the first rail member 10 upward in the form of partially cutting a material of the second rail member 20.

In addition, the second rail member 20 has a perforated hole 28 in the form of penetrating a material for coupling the detent member 40 by a riveting.

The intermediate rail member 30 is a pair of members located between the first rail member 10 and the second rail member 20, and is configured to be coupled to the first rail member 10 and the second rail member 20 to be relatively movable through the rolling means, respectively. To this end, the intermediate rail member 30 has a bent portion 32 for supporting the seating of the rolling means (not illustrated) on the side portions opposite to each other along the longitudinal direction. Even in this case, the bent portion 32 is formed to be bent to have an appropriate curvature for stable contact with the balls of the rolling means.

In addition, the intermediate rail member 30 has a first counter stopper 34 which is bent to limit the drawn-out stroke of the first rail member 10 to the intermediate rail member 30 by being in contact with the stopper 16 of the first rail member 10, and a second counter stopper 36 which is bent to limit the drawn-out stroke of the second rail member 20 to the intermediate rail member 30 by being in contact with the stopper 26 of the second rail member 20.

In this case, the first counter stopper 34 and the second counter stopper 36 are formed at both free ends of the intermediate rail member 30 to correspond to the stopper 16 of the first rail member 10 and the stopper 26 of the second rail member 20 at locations opposite to each other, when the intermediate rail member 30 is viewed as a whole.

The detent member 40 implements a detent function by an elastic displacement of each member in the drawn-into and drawn-out processes of the first rail member 10 with respect to the second rail member 20, and is formed in a cantilever shape which has one end fixed to the second rail member 20 and the other end protruding to be bent upward toward the locking projection 14 of the first rail member 10.

In this case, the detent member 40 may be formed of a separate structure which is detachably coupled to the second rail member 20, or formed of an integral structure which is formed together with the second rail member 20.

First, if the detent member 40 is formed of the separate structure which is detachably coupled to the second rail member 20, the structure is as follows.

That is, the detent member 40 has a fixing portion 42 which is formed parallel to the second rail member 20 for coupling the second rail member 20, a connecting portion 44 which extends integrally from the fixing portion 42 and is bent upward, and an elastic behavior portion 46 which extends integrally from the connecting portion 44 and is bent parallel to the fixing portion 42 while being spaced apart therefrom at a predetermined interval, and the elastic behavior portion 46 is configured to have an opening **46*a* for accommodating the locking projection 14 therein and a constraining protrusion 46*b* which is bent downward to suppress the separation of the locking projection 14 from the opening 46*a***.

Here, the opening **46*a* and the constraining protrusion 46*b* are each disposed on the same axis as the locking projection 14 based on the moving direction of the first rail member 10 with respect to the second rail member 20, and the width and length of the opening 46*a* are each set to sizes sufficient to accommodate the locking projection 14** therein.

In addition, the detent member 40 has a perforated hole **42*a* for coupling the second rail member 20 by a riveting, and has a recess 42*b* for coupling the locking protrusion 24, and the perforated hole 42*a* is formed to penetrate the fixing portion 42, and the recess 42*b* is formed in a shape which is recessed by being partially cut from the free end of the fixing portion 42. That is, the fixing portion 42 of the detent member 40 has the perforated hole 42*a* for coupling the second rail member 20 by the riveting, and the recess 42*b* for coupling the locking protrusion 24**.

In addition, the elastic behavior portion 46 has a drawn-into guide surface **46*c* which is formed of a structure which is bent downward toward the locking projection 14 at the free end of the elastic behavior portion 46 to be inclined to be in contact with the drawn-into inclined surface portion 14*a* of the locking projection 14**.

Figure 5:
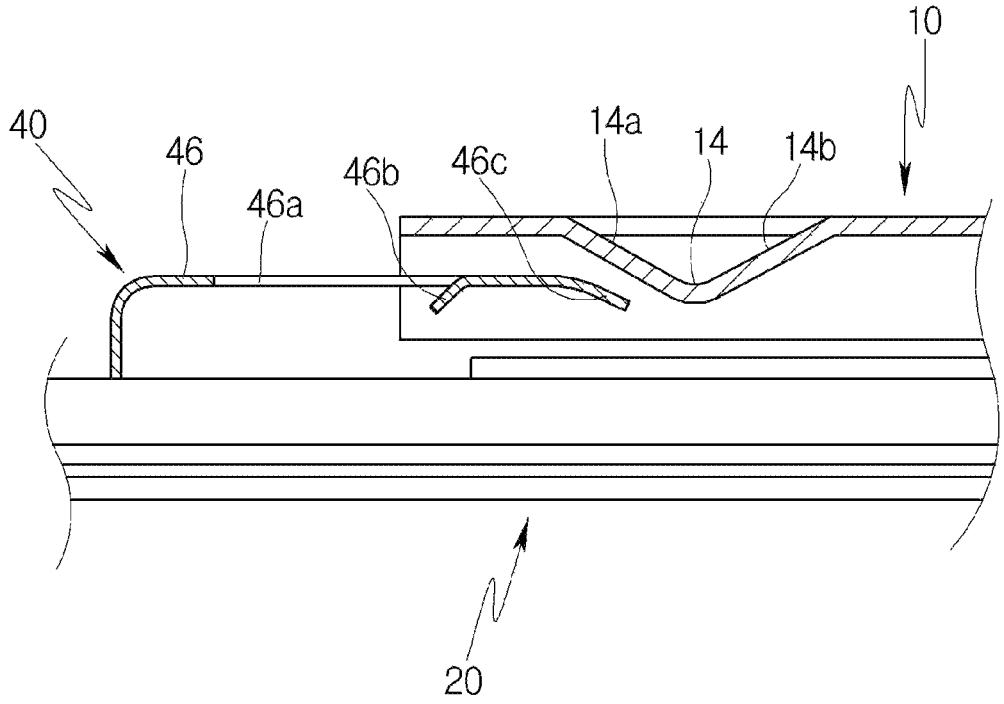
FIGS. 5 to 7 illustrate main portions of the present disclosure, and are enlarged cross-sectional diagrams sequentially illustrating the relative displacement relationship between a locking projection and a detent member in a drawn-into process of the rail member.
Figure 6:
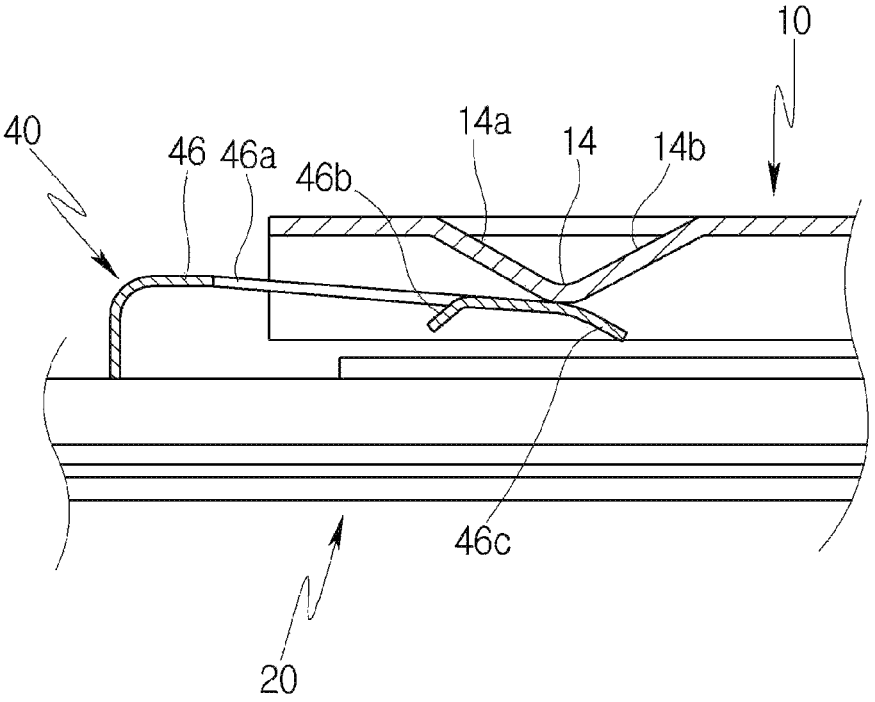
Figure 7:
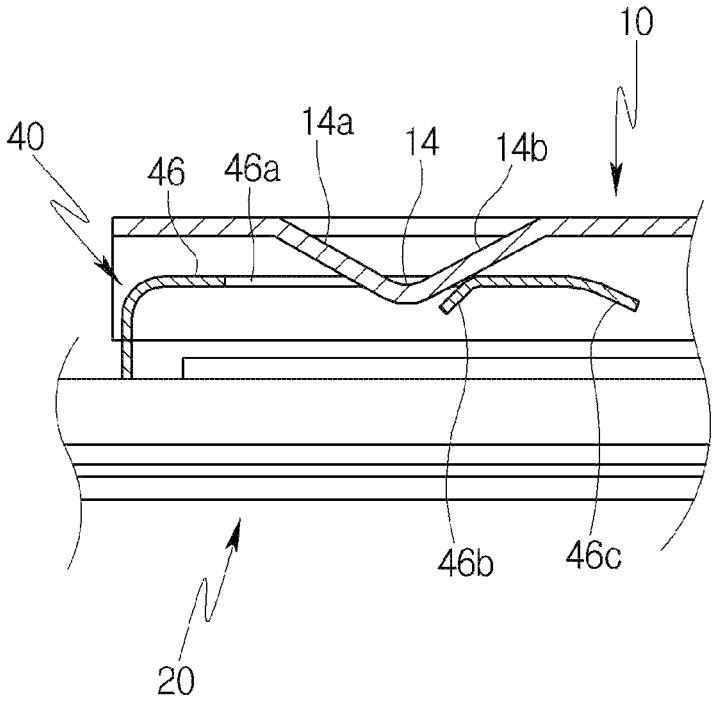

Accordingly, in the sliding device for the drawer according to the present disclosure configured as described above, as illustrated in FIGS. 5 to 7, the elastic behavior portion 46 of the detent member 40 may be displaced downward by the contact between the locking projection 14 and the detent member 40 to guide the entry of the locking projection 14 into the opening **46*a* in the process where the first rail member 10 moves to the drawn-into location to the second rail member 20**.

That is, the elastic behavior portion 46 of the detent member 40 may be displaced downward by a pressing force according to the contact between the drawn-into inclined surface portion **14*a* of the locking projection 14 and the drawn-into guide surface 46*c* of the elastic behavior portion 46, and thus the locking projection 14 smoothly enters into the opening 46*a* of the detent member 40**.

In this case, the constraining protrusion **46*b* of the detent member 40 may more actively limit the separation of the locking projection 14 from the opening 46*a* by being in contact with the drawn-out inclined surface portion 14*b* of the locking projection 14**, thereby implementing a fixed maintenance force having the robust state at the drawn-into location of the storage body to the main body.

In addition, according to the present disclosure, if the first rail member 10 moves to the drawn-out location to the second rail member 20, the downward displacement of the elastic behavior portion 46 may be naturally induced through the contact between the drawn-out inclined surface portion **14*b* of the locking projection 14 and the constraining protrusion 46*b* of the elastic behavior portion 46, and in this process, since the locking projection 14 may pass the constraining protrusion 46*b* of the elastic behavior portion 46 and easily escape outward from the opening 46*a***, the location of the storage body may be switched from the drawn-into location to the drawn-out location with respect to the main body.

In addition, as described above, when the storage body is switched to the drawn-out location while being switched to the drawn-into location with respect to the main body, the user may feel the shift manipulation feeling when the downward displacement of the elastic behavior portion 46 is accompanied by the contact between the locking projection 14 of the first rail member 10 and the elastic behavior portion 46 of the detent member 40, that is, the contact between the drawn-into inclined surface portion 14*a* of the locking projection 14 and the drawn-in guide surface 46*c* of the elastic behavior portion 46 and the contact between the drawn-out inclined surface portion 14*b* of the locking projection 14 and the constraining protrusion 46*b* of the elastic behavior portion 46.

Meanwhile, as another exemplary embodiment of the present disclosure, if the detent member 40 is formed of an integral structure which is formed together with the second rail member 20, the structure may be as follows.

Figure 8:
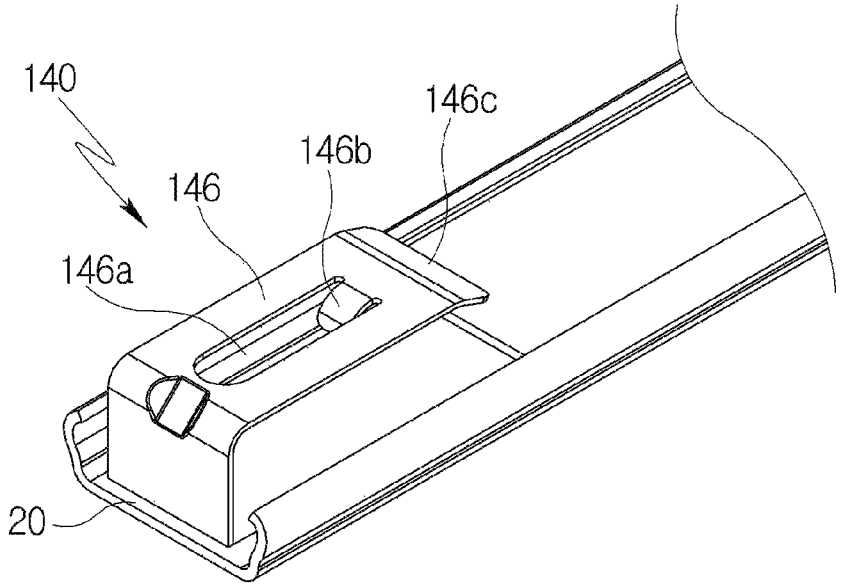
FIG. 8 is a perspective diagram illustrating a configuration of the detent member according to another exemplary embodiment of the present disclosure.

That is, referring to FIG. 8, the detent member 40 has a bending-type elastic behavior portion 146 with an integral structure which is partially cut from the material of the second rail member 20 and bent upward and then disposed parallel to the second rail member 20 while being spaced apart therefrom at a predetermined interval. In this case, the elastic behavior portion 146 is configured to have an opening 146*a* for accommodating the locking projection 14 therein, a constraining protrusion 146*b* which is bent downward toward the drawn-out inclined surface portion 14*b* to suppress the locking projection 14 from being separated from the opening 146*a*, and a drawn-into guide surface 146*c* having an inclined structure which is bent downward toward the drawn-into inclined surface portion 14*a* of the locking projection 14 at the free end of the elastic behavior portion 146 to be in contact with the drawn-into inclined surface portion 14*a* of the locking projection 14, as an integral structure.

In this case, it is natural that the configuration of the perforated hole 28 for the riveting with the locking protrusion 24 is removed from the second rail member 20, and it is natural that the configuration of the perforated hole 42*a* for the riveting and the recess 42*b* for coupling the locking protrusion 24 is also removed from the detent member 40. In addition, since the detent member 40 according to another exemplary embodiment of the present disclosure also performs the same operation and function as those in the exemplary embodiment, a detailed description thereof will be omitted.

The above description is merely illustrative of the technical spirit of the present disclosure, and those skilled in the art to which the present disclosure pertains may make various modifications and variations without departing from the essential characteristics of the present disclosure. Accordingly, the exemplary embodiments disclosed in the present disclosure are not intended to limit the technical spirit of the present disclosure, but to explain it, and the scope of the technical spirit of the present disclosure is not limited by these exemplary embodiments. Accordingly, the protection scope of the present disclosure should be interpreted by the appended claims, and all technical spirits within the equivalent range should be interpreted as being included in the scope of the present disclosure.

The invention claimed is:

1. A sliding device for a drawer comprising:

a first rail member;

an intermediate rail member which is coupled to be movable with respect to the first rail member;

a second rail member which is coupled to be movable with respect to the intermediate rail member at a location opposite to the first rail member;

a locking projection integrally formed on the first rail member, the locking projection having a drawn-out inclined surface portion inclined toward the second rail member; and a detent member provided on the second rail member and being elastically deformable when contacting the locking projection, the detent member comprising:

an elastic behavior portion being elastically deformed and spaced at an interval from and parallel to the second rail member;

an opening formed in the elastic behavior portion to receive the locking projection therein; and a constraining protrusion which suppresses the locking projection from being separated from the opening, the constraining protrusion protruding toward the opening and being bent with respect to the elastic behavior portion in a direction toward the second rail member so that when the first rail member is withdrawn from the second rail member, the elastic behavior portion is deflected toward the second rail member via contact between the constraining protrusion and the drawn-out inclined surface portion of the locking projection, wherein the locking projection and the opening are disposed on the same axis based on the moving direction of the first rail member with respect to the second rail member.

2. The sliding device for the drawer of claim 1, wherein the detent member comprises a fixing portion for coupling the detent member to the second rail member, wherein the elastic behavior portion is parallel to the fixing portion.

3. The sliding device for the drawer of claim 2, wherein the elastic behavior portion has a drawn-into guide surface which is bent downward toward the second rail member at a free end of the elastic behavior portion.

4. The sliding device for the drawer of claim 3, wherein the locking projection comprises a drawn-into inclined surface portion which is inclined downward toward the drawn-into guide surface at a location opposite to the drawn-out inclined surface portion.

5. The sliding device for the drawer of claim 4, wherein the drawn-into inclined surface portion and the drawn-out inclined surface portion are formed to protrude to have the same inclination angles based on the locking projection with respect to the first rail member.

6. The sliding device for the drawer of claim 1, wherein the second rail member has a locking protrusion which is bent upward for fixing the detent member.

7. The sliding device for the drawer of claim 6, wherein the detent member has a recess for coupling the locking protrusion.

8. The sliding device for the drawer of claim 1, wherein the detent member is partially cut from the second rail member and is bent upward and is integrally formed with the second rail member.

* * * * *